US005934372A

United States Patent [19]

Muth

[11] Patent Number: 5,934,372

[45] **Date of Patent: *Aug. 10, 1999**

[54] PUMP SYSTEM AND METHOD FOR PUMPING WELL FLUIDS

[75] Inventor: Garold M. Muth, Bakersfield, Calif.

[73] Assignee: Muth Pump LLC, Bakersfield, Calif.

[ * ] Notice: This patent is subject to a terminal disclaimer.

[21] Appl. No.: 08/899,785

[22] Filed: Jul. 24, 1997

Related U.S. Application Data

[62] Continuation-in-part of application No. 08/692,820, Jul. 29, 1996, Pat. No. 5,765,639, which is a continuation-in-part of application No. 08/325,971, filed as application No. PCT/US95/13290, Oct. 19, 1995, Pat. No. 5,505,258, and a continuation-in-part of application No. 08/610,630, Mar. 4, 1996, abandoned.

[51] Int. Cl.[6] ..... E21B 34/12; E21B 43/12

[52] U.S. Cl. ..... 166/72; 166/117; 166/313; 447/431

[58] Field of Search ..... 166/72, 313, 369, 166/117, 105; 417/431, 432

[56] References Cited

U.S. PATENT DOCUMENTS

| | | | |
|---|---|---|---|
| 2,797,642 | 7/1957 | Bloudoff | 103/4 |
| 3,167,019 | 1/1965 | Harris | 103/4 |
| 3,765,483 | 10/1973 | Vencil | 166/265 |
| 3,771,603 | 11/1973 | Crowe | 166/314 |
| 3,802,802 | 4/1974 | Greer | 417/98 |
| 4,056,335 | 11/1977 | Secrist | 417/431 |
| 4,646,839 | 3/1987 | Rickey | 166/335 |

*Primary Examiner*—Terry Lee Melius

*Attorney, Agent, or Firm*—Townsend and Townsend and Crew

[57] ABSTRACT

The invention provides apparatus for producing well fluids from an oil bearing formation penetrated by a well. The apparatus includes a tubing string forming a production flow path for production fluids between the earth's surface and a location in the well suitable for receiving well production fluids, a power tubing generally parallel to the production tubing and connected to the flow path of the production tubing, and a cross over flow mechanism to divert the flow of production fluids from the power tubing to the production flow path. A lubricant flow path extends from the earth's surface to a location near a pumping apparatus disposed in the power tubing to allow a lubricant to be introduced into the pumping apparatus.

24 Claims, 10 Drawing Sheets

PUMP SYSTEM AND METHOD FOR PUMPING WELL FLUIDS

RELATED APPLICATIONS

This application is a continuation-in-part of U.S. patent application Ser. No. 08/692,820, filed Jul. 29, 1996, now U.S. Pat. No. 5,765,639, which is a continuation-in-part application of U.S. patent application Ser. No. 08/325,971, filed Oct. 20, 1994, now U.S. Pat. No. 5,505,258; PCT/US95/13290, filed Oct. 19, 1995; and U.S. application Ser. No. 08/610,630, filed Mar. 4, 1996 now abandoned. All of these applications are incorporated herein by reference for all purposes.

BACKGROUND OF THE INVENTION

1. Field of the Invention

The present invention is directed to a pumping system for producing well fluids from petroleum producing formations penetrated by a well. The present invention includes the use of dual parallel tubing strings having the lower portions connected by a crossover flow connection, one of the tubing strings, i.e., the production tubing string, forming a flow path for flowing production fluids to the surface and the other, i.e., the power tubing string, for providing a conduit for inserting, operating and removing a rod-activated pump plunger used to lift well fluids from the well and to move the well fluids up the well to the surface through the crossover flow connection. A flow control valve for controlling production flow is also provided. A lubricating plunger is provided to direct fluid from the annulus between the power tubing and the rods to an area between the barrel of the pump and the lubricating plunger to increase the efficiency of the pump and to assist in sand control.

2. Description of Related Art

Pumping well fluids from wells penetrating producing formations has been done for many years. This is particularly true where heavy viscous oil must be moved to the surface. Often heavy viscous oils such as produced from California formations which are relatively close to the earth's surface contain sand and are difficult to pump. Steam and diluents have often been used to lower the viscosity of heavy crudes to improve flow and pumping efficiency; however, sand is still a major problem.

Heretofore dual tubing strings for a pumping system for producing petroleum have been suggested. For example, pumping installations utilizing parallel dual tubing strings are disclosed in U.S. Pat. No. 4,056,335 to Walter S. Secrest; 3,802,802 to F. Conrad Greer; and 3,167,019 to J. W. Harris.

There is still need, however, for a pumping system having dual production and power tubing strings which permit ease of operation which has movable parts including the pump plunger which may be removed from the power tubing string and replaced in the tubing string without the need for removing the tubing strings from the well, leaving only the pump barrel and tubing in place.

SUMMARY OF THE INVENTION

The present invention provides apparatus for producing well fluids from an oil bearing formation penetrated by a well including production tubing means forming a production flow path for production fluids between the earth's surface and a location in the well suitable for receiving well production fluids from a pump located in a parallel power tubing means. Flow control means are preferably located in the lower portion of the apparatus to permit flow of production fluids up the production flow path and to prevent flow of production fluids down the production flow path. Power tubing means extend down the well in parallel relationship with the production tubing means to a location in the well suitable for receiving production fluids into the lower portion of the power tubing means from said well. An insert or tubing-type lubricating plunger is provided, and the plunger is preferably adapted to be inserted and removed from the power tubing means while the power tubing means are located in the well. A standing valve is provided to permit entry of well fluids from the producing formation into the lower portion of the power tubing means. A crossover flow path is formed between the lower portion of the power tubing means and the flow path of the production tubing means for flowing production fluids out of the power tubing means and into the flow path of the production tubing means as the only flow path for transfer of production fluids to the earth's surface. Rod means for operating the tubing-type pump are operatively connected to the pump. Preferably, the means for operating the pump includes a rod string extending down the power tubing means and operably connected to the plunger of the insert or tubing-type pump. The operative elements of the insert or tubing-type pump are preferably located in the well below the location of the flow control means. The pump barrel of the tubing-type pump is a lowest section of the power tubing string. A valve is provided for flowing lubricating fluid from the power tubing string into a hollow pull tube connecting the lower end of the rod string to a lubricating plunger of the pump. The lubricating plunger has flow ports for permitting flow of lubricating fluid from inside the plunger to the annulus between the outside of the plunger and the inside of the pump barrel. The plunger is used in the tubing pump to receive fluids from the pull tube to lubricate the pump, to improve its efficiency and to control sand from entering the area of between the plunger and barrel.

In a more specific aspect the present invention provides apparatus for pumping petroleum from a well penetrating a petroleum producing formation which includes a downhole assembly located in a well at a position adapted to receive petroleum fluids from the well. The downhole assembly includes a parallel anchor having a first passage and a second passage formed parallel to the central axis of the parallel anchor. Means are provided for mounting the parallel anchor in the well at the desired position and a tubular connecting pup is connected to the first passage of the parallel anchor and extends down the well. A flow control means such as a standing valve, or a sliding valve, which permits flow up the connecting pup tubing and prevents flow down the connecting pup tubing is connected in the lower portion of the apparatus, for example, in or near the connecting pup. A crossover flow head is connected between the lower end of the connecting pup tubing below the standing valve and an opening in the pump barrel to provide a flow path for petroleum from the pump barrel through the standing valve into the lower portion of the connecting pup tubing. A production tubing string extends from the earth's surface down the well and is inserted into the first passage of the parallel anchor to form, in combination with the crossover flow head, the connecting pup tubing and a tubular string, a flow path to the earth's surface for petroleum. A power tubing string is positioned in the well parallel to the production tubing string and extends through the second passage in the parallel anchor. Connecting means connect the lower end of the power tubing string to the upper end of the tubular landing nipple. A tubing-type seal off is inserted into the power tubing and landed in the tubular landing nipple.

Means are provided to form a flow path for petroleum between the lower portion of the power tubing string and the lower portion of the production tubing string. Means are provided for disconnectably connecting the plunger of the tubing-type pump in operating position in the power tubing and the landing nipple for pumping fluid up the power tubing string to the flow path of the production tubing string. A lubricating plunger is provided for flowing lubricating fluid into the annulus formed between the pump barrel and a pump plunger.

The present invention provides an assembly which includes parallel power tubing and production tubing strings. A lubricating plunger is located inside and at the bottom of the power tubing string. The power tubing string connects to a bottom hole assembly with a crossover flow head which connects with the production tubing string. This provides for flow of production fluids from the pump to the production tubing string. A rod string, connected to a pumping unit at the surface gives the lubricating plunger of the tubing-type pump an up-and-down motion for pumping the well fluid to the surface through this production tubing string. A "Beard" valve is connected at the lower end of the rod string. The "Beard" valve includes a port to permit fluid flow from the power tubing annulus into the interior of the "Beard" valve. A hollow pull tube is connected to the lower end of the "Beard" valve and extends to and is connected to the lubricating plunger to provide for flow of lubricating fluids to the plunger. The plunger has ports for flowing the lubricating fluid out into the annulus between the plunger and the pump barrel. Thus, diluent or water with a surfactant may be placed in the power tubing for use in lubrication of the tubing pump to improve the efficiency thereof and to prevent sanding up of the pump.

The present invention utilized a tubing insert plunger. Thus, the plunger of the pump is connected to the rod string and is inserted inside the power tubing string. The lowermost section of the power tubing string forms the barrel of the pump. Generally, only the rod string has to be pulled to retrieve all moving and wearable pump parts except for the pump barrel. Thus, the apparatus of the present invention will save rig time when pump repairs or replacement is needed. Also because the production flow path is separated from the pumping rod string, the apparatus of the present invention will never have a floating rod problem. It will also eliminate inertia bars and require smaller less expensive rods. In addition, lubricating fluid may be injected down the power tubing string through the "Beard" valve and the hollow pull tube rod and into a lubricating plunger of the pump. The lubricating plunger is provided with ports to direct the fluid coming from the hollow pull tube into the area between the plunger and pump barrel. Increasing the pressure in the annulus of the power tubing to exceed that of the production tubing keep sand out of the area between the plunger and pump barrel and to increase pump efficiency.

In one exemplary embodiment, the invention provides an apparatus for producing well fluids from an oil bearing formation penetrated by a well. The apparatus comprises a production tubing string which forms a production flow path for production fluids. The production tubing string is configured so that it may be positioned between the earth's surface and a location in the well suitable for receiving well production fluids. A power tubing string is also provided and includes an upper portion and a lower portion. The power tubing string extends down the well in a generally parallel relationship with the production tubing string to a location in the well suitable for receiving production fluids into the lower portion of the power tubing string. A pumping apparatus is disposed in the power tubing string to pump well fluids from the well into the lower portion of the power tubing string. Further, a crossover flow mechanism is provided between the lower portion of the power tubing string and the flow path of the production tubing string to divert the flow of production fluids out of the power tubing string and into the flow path of the production tubing string where it may be transferred to the earth's surface. A lubricant flow path is also provided and extends from the earth's surface to a location near the pumping mechanism to allow lubricants to be introduced into the pumping mechanism. In this way, lubricants may be provided to the pumping mechanism to substantially hinder undue wear that may be caused by sand or other coarse particulate found within the production fluids.

In one particular aspect, the production flow path has a smaller cross-sectional area than the lower portion of the power tubing string to increase the velocity of the production fluids when diverted into the production flow path. In this way, sand or other coarse particulate within the production fluids will remain suspended and will not tend to settle within the tubing strings to hinder operation of the apparatus.

Two different arrangements of the lubricant flow path may be provided to supply lubricant to the pumping mechanism. In one alternative, the lubricant flow path may pass through substantially the entire length of the power tubing string. More specifically, the lubricant flow path may pass through the crossover flow mechanism. In this way, the overall size of the power tubing string may be reduced. In one particularly preferable implementation, the lubricant flow path will pass through at least one rod which extends through the power tubing string and which is used to operate the pumping mechanism.

In the second alternative, the lubricant flow path may be arranged to bypass the crossover flow mechanism. For instance, a side tubing string may be provided to bypass the crossover flow mechanism. The side tubing string will preferably have a bottom end which is connected to a lower portion of the power tubing string near the pumping mechanism so that the lubricant may be provided to the pumping mechanism.

With both the passthrough and bypass embodiments just described, a variety of pumping mechanisms may be employed. For example, the pumping mechanisms may comprise an insert pump, a progressive cavity pump, a tubing pump, and the like.

OBJECT OF THE INVENTION

A principal object of the present invention is to provide a pumping system having parallel power tubing and production tubing strings in which production is flowed up the production tubing through a flow control valve connected at the lower end of the pumping system. A rod operated insertable and removable pump plunger is disconnectably connected into the power tubing wherein the pump plunger may be removed from and inserted into the power tubing without the need to remove the tubing string from the well. A hollow pull tube is connected to the lower end of the rod string by a "Beard" valve and used to operate the pump plunger and also to provide a source of lubricating fluid for the lubricating plunger of the pump. The plunger has ports for flowing the fluid into the area between the pump barrel formed by the lower end of the power tubing and the outside of the plunger with increased pressure in the pump annulus to inhibit sand production and to increase pump efficiency.

The increased pressure is accomplished by appropriate surface mechanism such as a pump. Additional objects and advantages of the present invention will become apparent to those skilled in the art from the drawings which are made a part of this specification and the detailed description of the invention.

DETAILED DESCRIPTION OF THE INVENTION

Figure 1:
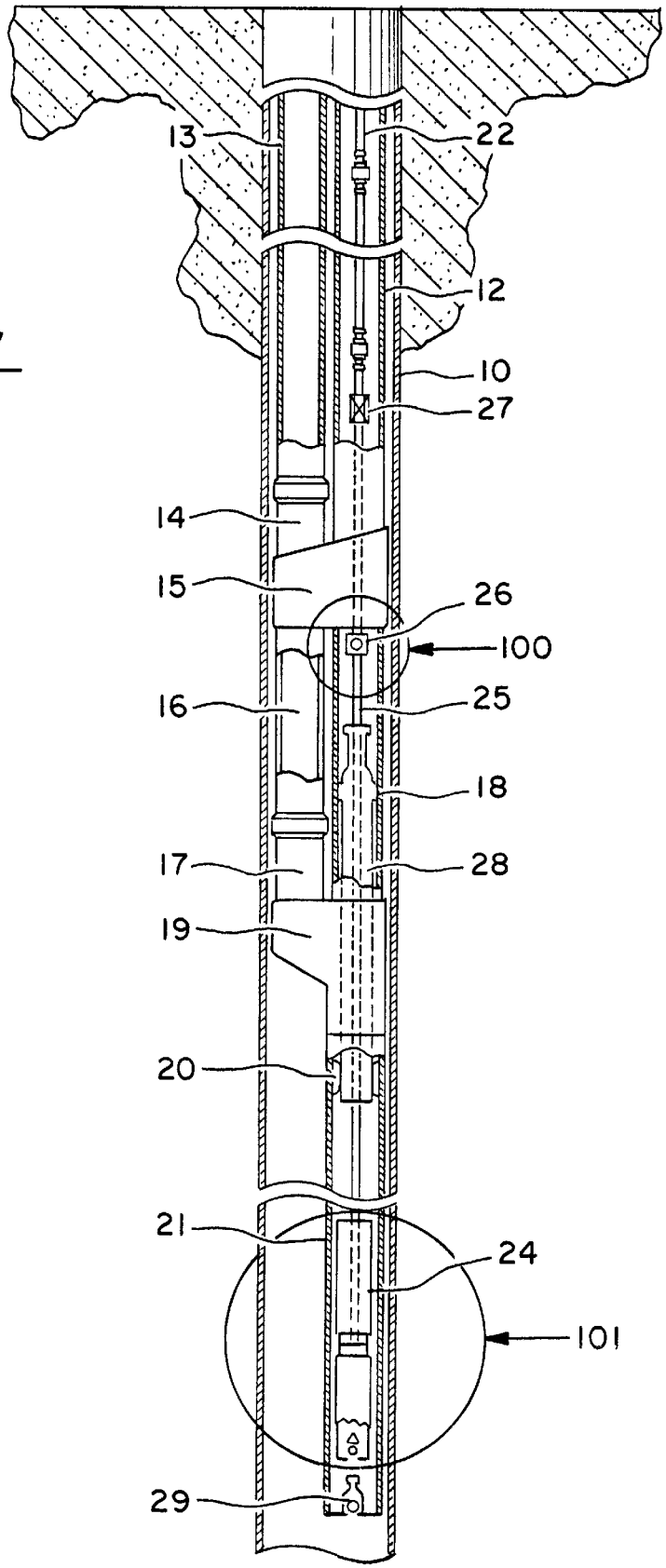
FIG. 1 is a diagrammatic vertical sectional view of a well equipped with a pumping system assembled in accordance with the present invention.

FIG. 1 shows an overall sectional view of a pumping assembly in accordance with the present invention. A casing 10 is operably positioned in the well. Parallel power tubing 12 and production tubing 13 strings are positioned in the casing and connect with the bottom hole assembly which houses a down hole tubing pump and insert plunger 24 having lubricating ports 81–84 (see FIGS. 4–5). The power tubing 12 and the production tubing 13 provide paths between the surface and a position in a well where well fluids are produced. As shown in FIG. 1, parallel anchor 15 has a first passage on the left and a second passage on the right of the anchor. A stab in tubing member 14 forming the bottom of the tubing string 13 extends through the first passage and is attached to the top of a connecting pup tubing 16 that screws into the top of a standing valve nipple 17. A crossover flow head 19 attaches to the bottom of the standing valve nipple 17 on the left side. The right side of the crossover flow head 19 is attached to the bottom of a lock shoe landing nipple 18 and the top of sealing nipple 20. The power tubing string 12 passes down through the second passage in parallel anchor 15 on the right side and screws into the top of the lock shoe landing nipple 18. Beneath the cross-over flow head 19 is a sealing nipple 20. A pump barrel 21, which is preferably the lowermost section of the power tubing string, is provided below the sealing nipple 20. When the production tubing string 13 is installed, the power tubing string 12 and the bottom hole assembly are already made up together and in place down hole in the well at a suitable location for recovering well fluids.

The production tubing string 13 has attached to the bottom of it a stinger 14 with seals which then stabs into the passage provided in the left side of the parallel anchor 15. At the surface the production string 13 is connected to a conventional flow line which carries well fluids off to a production tank. A tubing-type insert plunger 24 having lubricating ports 81–84 is adapted to be inserted and removed from the power tubing. The lubricating plunger 24 has a hollow pull tube 25 that is connected to a rod string 22. The hollow pull tube 25 is connected to the rod string 22 by means of a "Beard" valve 26. The rod string 22 protrudes upward through the inside of the power tubing string 12 to the surface and is then hung off the bridle and horses head of a conventional pumping unit. The pumping unit gives the plunger 24 its up and down motion to pump the well fluids to the surface. The down hole seal off 28 is also sealed inside of the top lock shoe landing nipple 18 which holds the body or outside of the seal off 28 in place and allows only the plunger 24 to reciprocate up and down in the pump barrel 21 to pump the well fluids. The nipple 17 provides a flow control means in the production tubing flow path. Flow control means, such as a traveling valve or a sliding sleeve, are fully described in my earlier application Ser. No. 08/325,971 and PCT/US95/13290, which have been incorporated by reference. A standing valve 29 at the lower end of the pump permits flow of well fluids into the lower portion of the pump barrel.

Referring again to FIG. 1 which shows the bottom hole assembly in more detail, the parallel anchor 15, with a stab in tubing member 14 having a sealing port for stabbing in, is attached to the top of the connecting pup 16 that screws into the top of the standing valve nipple 17. The cross-over flow head 19 attaches to the bottom of the standing valve nipple 17 on the left side. The right side of the cross-over flow head 19 is attached to the bottom lock shoe landing nipple 18 and the top sealing nipple 20. The power tubing string 12 then passes down through the parallel anchor 15 on the right side and screws into the top of the top lock shoe landing nipple 18. Beneath the cross-over flow head 19 is a sealing nipple 20 which screws into the top of the pump barrel 21. When the production tubing string 13 is installed, the power tubing string 12 and the bottom hole assembly are already made up together and in place down hole. The production tubing string 13 has attached to the bottom of it a stinger 14 with seals which then stabs into the left side of the parallel anchor 15.

Retrieving the bottom hole assembly from the well should never be necessary unless a hole develops in the power tubing string 12 from wear by the action of the rod string 22 or if there is sufficient wear of the pump barrel from the plunger 24. If this should happen, while the insert plunger is at the surface, simply pull the production tubing string 13, unsealing the stinger 14 with seals out of the parallel anchor 15. After this apparatus is at the surface, the bottom hole assembly may be pulled out with the power tubing string 12.

Figure 2:
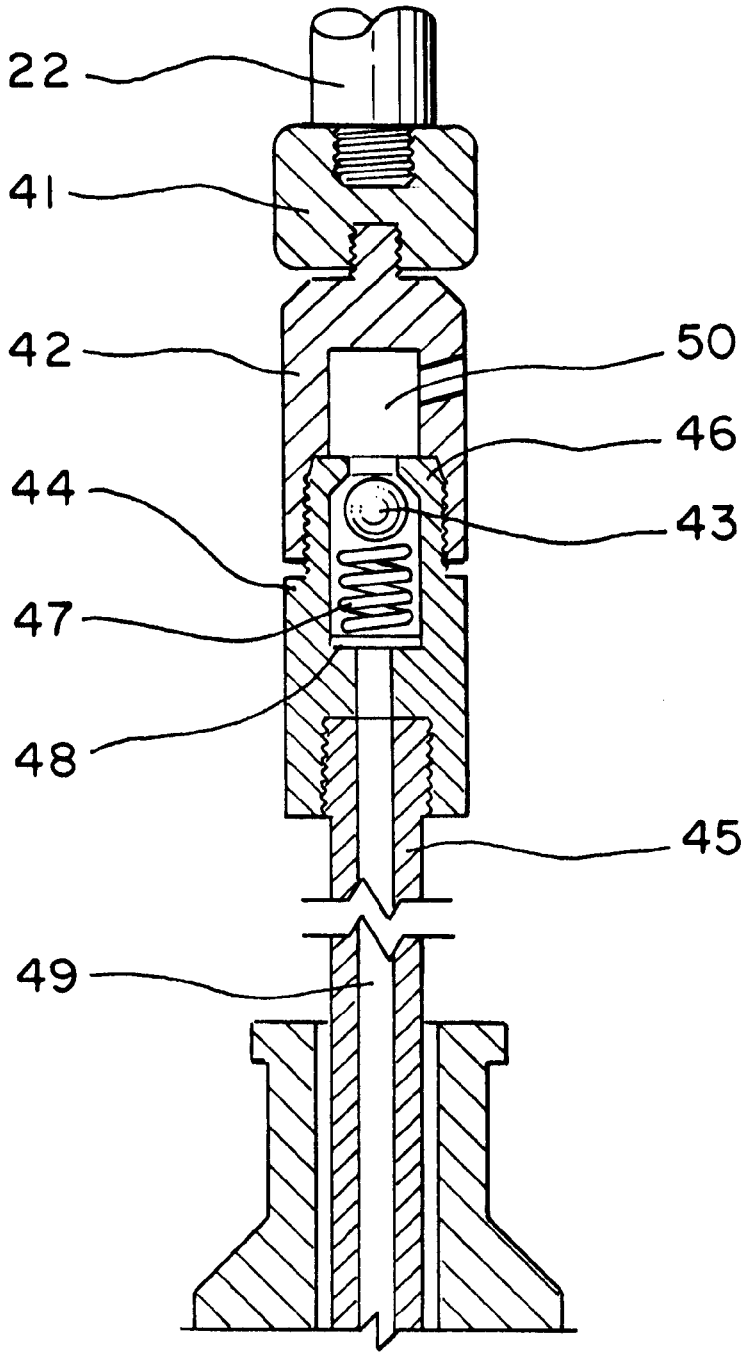
FIG. 2 is an enlarged vertical sectional view of the portion of the system of FIG. 1 indicated by 100 in FIG. 1.

FIG. 2 is an enlarged sectional view of "Beard" valve 26 shown in FIG. 1 in the circle indicated by the number 100. The valve 26 is connected to the rod string 22. The "Beard" valve comprises a rod box 41 which is threadedly connected to an upper mandrel section 42 at its lower end. The mandrel section has a port 50 to permit flow of a lubricating fluid into the interior of the valve. A mating mandrel section 44 is threadedly connected to the upper mandrel section 42. A hollow pull tube 25 having an interior flow path 49 is connected to the lower mandrel 44 and to the top of the lubricating plunger 24. A check valve ball 43 and spring 47 which seats on seat 46 in mandrel section 44 and 42 permits flow of lubricating fluid downward through port 50 into pull tube 45 when pressure on the fluid in the power tubing is increased above the pressure in the pump barrel. The fluid flows to the lubricating plunger 24 inside of pump barrel 21.

Figure 3:
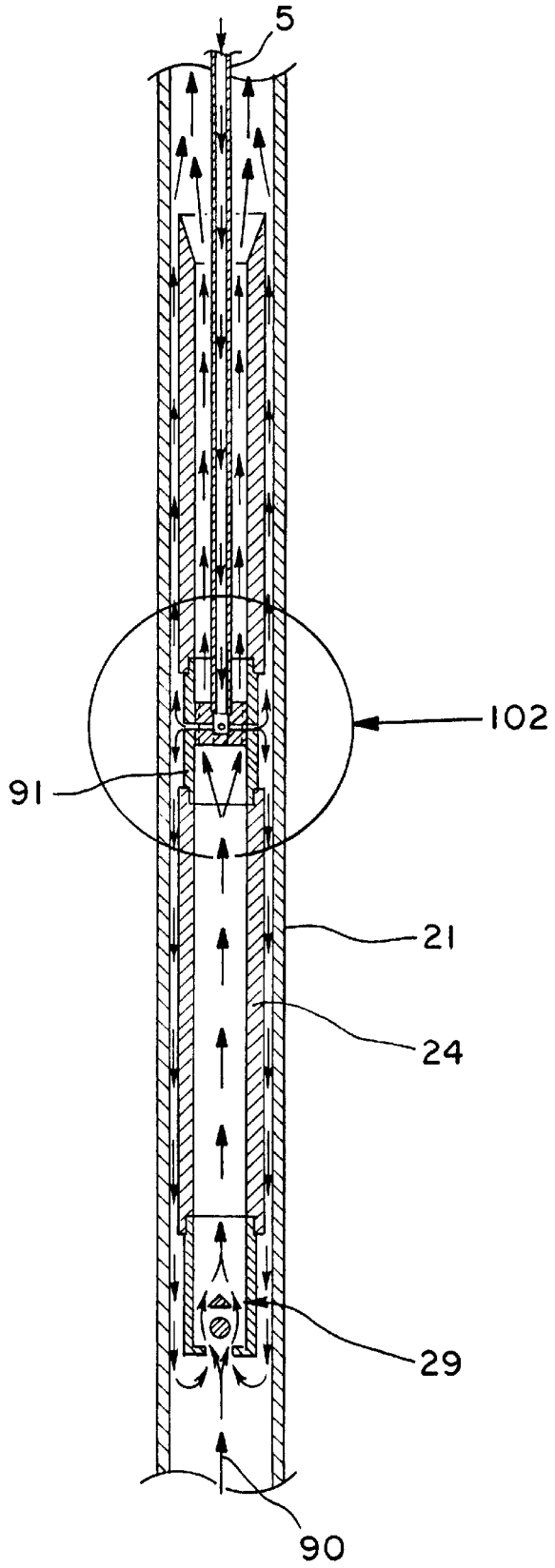
FIG. 3 is an enlarged vertical sectional view of the portion of the system of FIG. 1 indicated at 101 in FIG. 1.
Figure 4:
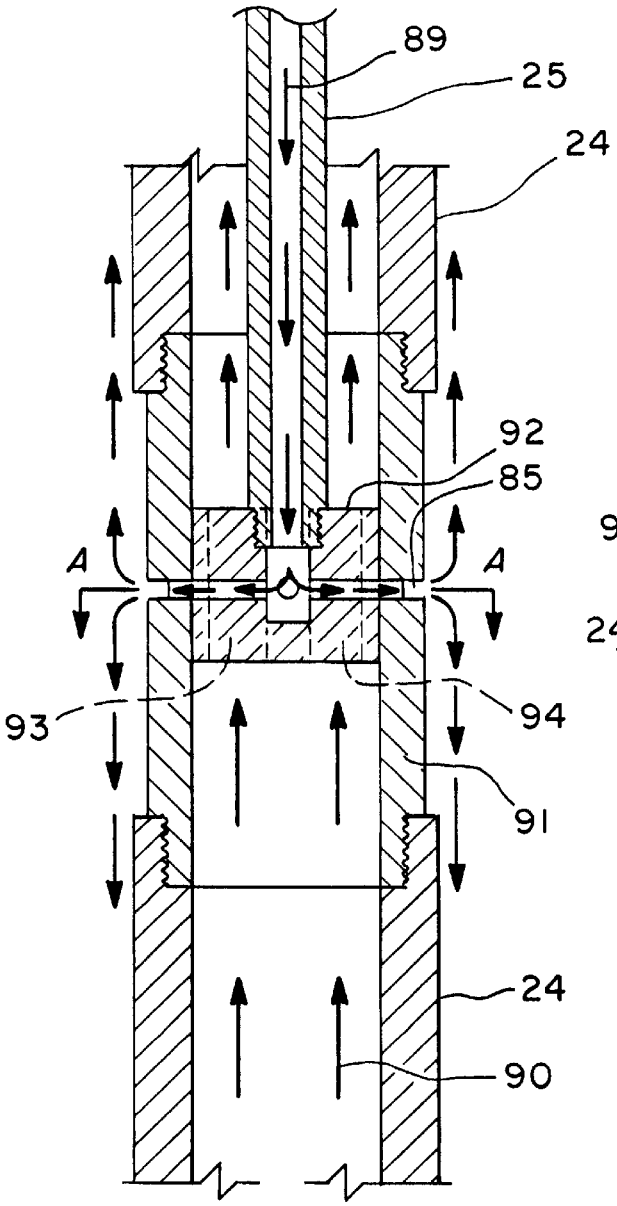
FIG. 4 is an enlarged vertical sectional view of the portion of the system of FIG. 3 indicated by 102 in FIG. 3.
Figure 5:
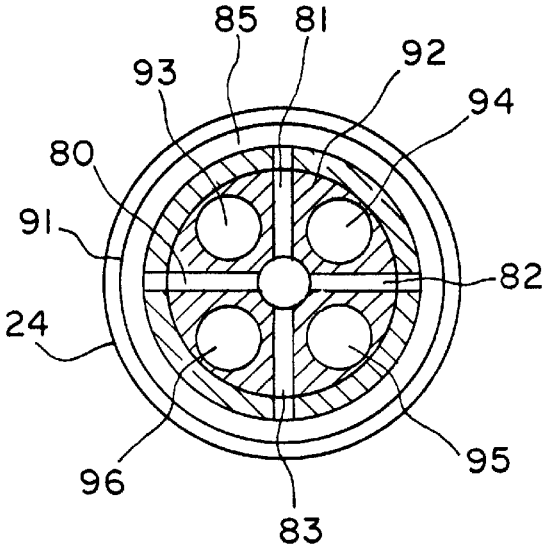
FIG. 5 is a sectional view taken at A—A of FIG. 4.

Referring now to FIG. 3 which illustrates the lubricating plunger 24 and associated elements shown generally in the circle numbered 101 in FIG. 1. FIG. 3 is an enlarged vertical sectional view of the pump barrel 21 and the lubricating plunger 24. FIG. 4 is a more greatly enlarged vertical section of the mid-portion of the plunger 24 at the circle 102 of FIG. 3, and FIG. 5 is a sectional view taken at A—A of FIG. 4.

In FIG. 3 the lubricating plunger 24 is illustrated in the downstroke portion of the pump cycle. Arrows, indicated generally as 90, show the flow of well fluids through the traveling valve, ball, seat, and cage indicated generally as 29 up the interior of the plunger 24. As shown in FIG. 5, the well fluids pass through insert 92 in plunger connector 91 by means of ports 93–96. At the end of the downstroke and the beginning of the upstroke well fluids are raised up the production tubing as the traveling valve 29 closes.

Lubricating fluid 89 flows down hollow pull tube 25 to insert 92 in the plunger connector 91. The lubricating fluid then passes through ports 81, 82, 83 and 84 into the area between pump barrel 21-plunger 24 annulus indicated by the number 85 in FIG. 5. This lubricating fluid lubricates the plunger and pump barrel in annulus 85 to help prevent sanding of the pump. The lubricating fluid comes from the power tubing through the "Beard" valve into the hollow pull tube. The lubricating fluid is injected by means of increasing the pressure on the fluid in the power tubing to a pressure higher than the pressure in the annulus 85 plus pressure drop in the "Beard" valve and hollow pull tube.

Thus, the present invention provides apparatus for producing well fluids from an oil bearing formation penetrated by a well including production tubing means forming a production flow path for production fluids between the earth's surface and a location in the well suitable for receiving well production fluids from a pump located in a parallel power tubing means. Flow control means are located in the lower portion of the apparatus to permit flow of production fluids up the production flow path and to prevent flow of production fluids down the production flow path. Power tubing means are extended down the well in parallel relationship with the production tubing means to a location in the well suitable for receiving production fluids into the lower portion of the power tubing means from said well. A tubing-type plunger is provided and is adapted to be inserted and removed from the power tubing means while the power tubing means are located in the well. Means are provided for entry of well fluids from the well into the lower portion of the power tubing means for pumping therefrom. A crossover flow path is formed between the lower portion of the power tubing means and the flow path of the production tubing means for flowing production fluids out of the power tubing means and into the flow path of the production tubing means as the only flow path for transfer of production fluids to the earth's surface. Rod means for operating the tubing-type pump are operatively connected to the pump. Preferably, the means for operating the pump includes a rod string extending down the power tubing means and operably connected to the plunger of the tubing-type pump. The operative elements of the insert type pump are preferably located in the well below the location of the flow control means. A valve is provided for flowing lubricating fluid from the power tubing string into a hollow pull tube connecting the lower end of the rod string to a lubricating plunger of the pump. The lubricating plunger has flow ports for permitting flow of lubricating fluid from inside the plunger to the annulus between the outside of the plunger and the inside of the pump barrel. The plunger is used in the tubing pump to receive fluids from the pull tube to lubricate the pump and to improve its efficiency and to control sand from entering the area of between the plunger and barrel.

Figures 6, 6A:
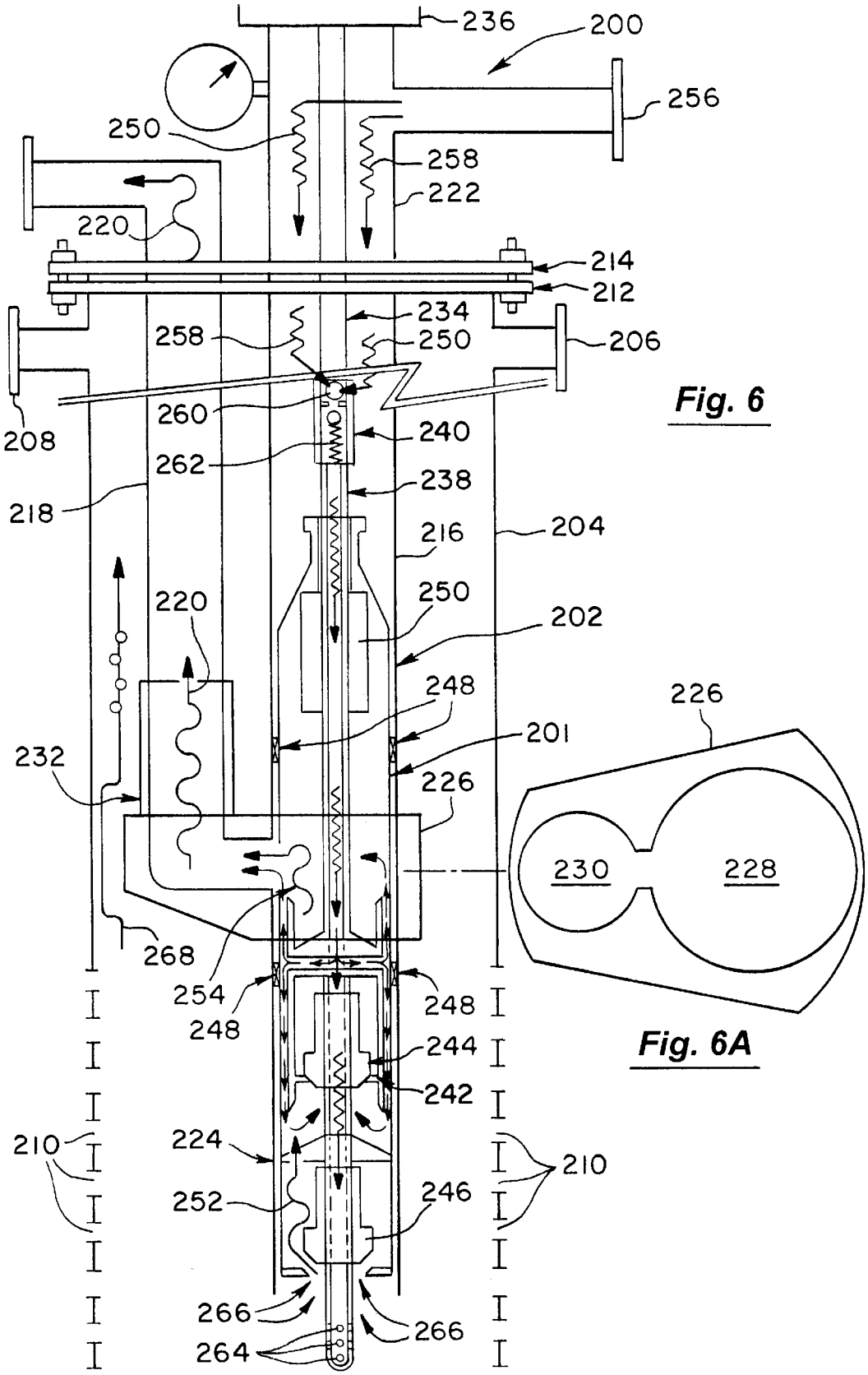
FIG. 6 is a diagrammatic vertical sectional view of a pumping system having an insert pump and a lubricant flow path passing directly through a power tubing string according to the invention.
FIG. 6A is a cross-sectional view of a crossover flow head of the pumping system of FIG. 6.
Figures 7, 7A:
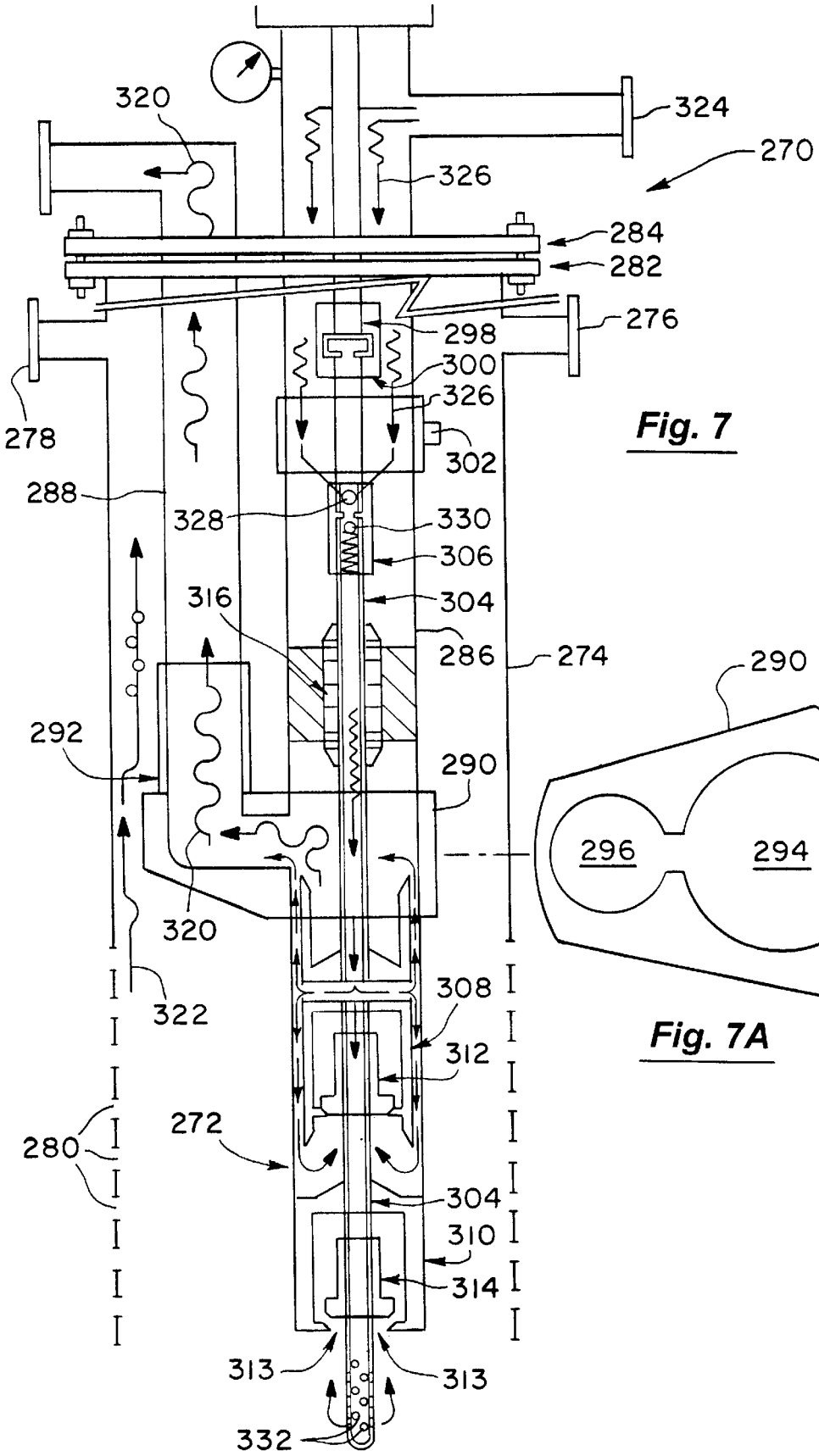
FIG. 7 is a diagrammatic vertical sectional view of a pumping system having a tubing pump and a lubricant flow path passing directly through a power tubing string according to the invention.
FIG. 7A is a cross-sectional view of a crossover flow head of the pumping system of FIG. 7.
Figure 8:
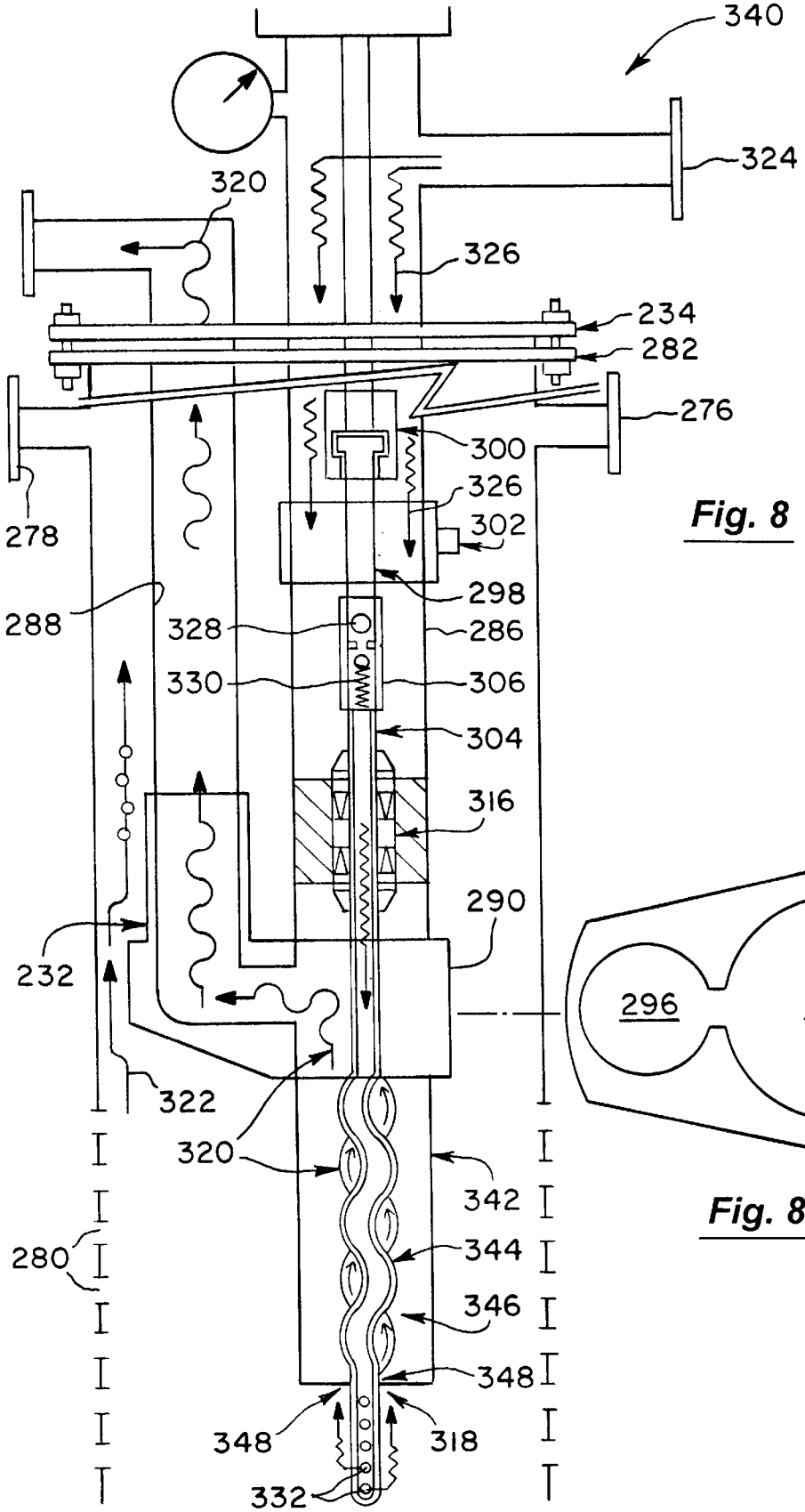
FIG. 8 is a diagrammatic vertical sectional view of a pumping system having a progressive cavity pump and a lubricant flow path passing directly through a power tubing string according to the invention.

Referring now to FIGS. 6–8, three pumping system embodiments will be described which each have a lubricant flow path which passes directly through the power tubing string to introduce a lubricant to a pumping mechanism. In this way, the overall size of the pumping system may be reduced by allowing the lubricant to flow through an existing tubing string.

Referring first to FIG. 6, a pumping system 200 having an insert pump 202 will be described. Pumping system 200 comprises a casing 204 having a pair of vents 206, 208 and a plurality of perforations 210 (or liner slots) which allow production fluids to pass through casing 204. Casing 204 further includes a flange 212 is secured to a dual well head flange 214 to hold a power tubing string 216 and a production tubing string 218 within the well. Production tubing string 218 defines a flow path 220 as indicated by the arrows. Power tubing string 216 includes an upper portion 222 and a lower portion 224. Lower portion 224 includes insert pump 202.

Connecting power tubing string 216 to production tubing string 218 is a crossover flow head 226 (see also FIG. 6A). Conveniently, a tubing release 232 is provided to connect production tubing string 218 to crossover flow head 226. As illustrated in FIG. 6A, the crossover flow head includes a power tubing string portion 228 and a production tubing string portion 230. Portion 230 has a smaller crosssectional area than portion 228 so that when production fluids are diverted from portion 228 and into portion 230, the rate of flow of the production fluid will increase. In this way, sand or other coarse particulate within the production fluids will remain generally suspended until exiting production tubing string 218 above the earth's surface.

Extending through power tubing string 216 is a rod 234. Rod 234 is preferably constructed to be solid and passes through a stuffing box 236 as is known in the art. Solid rod 234 is connected to a hollow rod 238 by a check valve 240. In turn, hollow rod 238 is employed to operate insert pump 202.

Insert pump 202 comprises a plunger 242 which moves in an up and down motion as dictated by hollow rod 238. Operably attached to hollow rod 238 is a ring traveling valve 244 and a ring standing valve 246. Conveniently, friction rings 248 are provided to form a seal between the pump barrel below plunger 242 and power tubing string 216. A sealing unit 250 is further provided to prevent production fluids from traveling up power tubing string 216 as described in greater detail hereinafter.

Upon upstroke of hollow rod 238, plunger 242 is lifted to create a vacuum within the pump barrel below plunger 242. In turn, ring standing valve 246 is lifted by this vacuum to allow production fluids to enter into lower portion of pump barrel below plunger 242 as indicated by arrow 252. Upon downstroke of the plunger 242, positive pressure is created within lower portion of the pump barrel below plunger 242, causing ring standing valve 246 to close and causing ring traveling valve 244 to unseat. In turn, the production fluids within lower portion of the pump barrel below plunger 242 pass through plunger 242 and into crossover flow head 226 as illustrated by arrows 254. At this point, sealing unit 250 prevents the production fluids from passing further through power tubing string 216. Hence, the production fluids cross over from portion 228 and into portion 230, where they travel through production tubing string 218 until they exit above the earth's surface.

To provide a lubricant and/or a diluent to appropriate locations, the lubricant or diluent may be input into power tubing string 216 through a port 256. As indicated by arrows 258, the lubricant will lubricate between the up and down motion of rods 234 and the stationary power tuber string 216. The lubricant will then pass through a hole 260 in check valve 240 if the lubricant is under sufficient pressure to unseat spring valve 262. The lubricant then passes through hollow rod 238 as shown. During its travel, the lubricant may exit hollow rod 238 in the middle of plunger 242 as shown to lubricate the surfaces between plunger 242 and pump barrel 201. Some of the lubricant will continue its path through hollow rod 238 until exiting through a plurality of orifices 264. In this manner, the lubricant will also serve as a wetting agent to water wet all metal surfaces in pump 202 to assist in flowing production fluids into power tubing string 216 as indicated by arrows 266. In the same manner (using diluent), the diluent will reduce the viscosity of the production fluids assisting in the flowing of production fluids into the power tubing string 216 as indicated by arrows 266.

Hence, by constructing rod 238 to be hollow, a lubricant and/or diluent may be passed directly through power tubing string 216 into hollow rod 238 to supply a lubricant/diluent to plunger 242 and to supply a lubricant/diluent to the production fluid to assist in removing the production fluid from the well. By passing rod 238 directly through power tubing string 216, the outer diameter of pumping system 200 may be reduced, while still providing an effective way to supply the lubricant/diluent to the suction of the pump. As illustrated by arrow 268, sufficient space is also provided between casing 204 and strings 216 and 218 to allow free gas to escape from the well.

Another particular advantage of pumping system 200 is that insert pump 202 may be pulled from power tubing string 216 while power tubing string 216 remains in the well. In this way, insert pump 202 may conveniently be repaired or replaced without having to pull any tubing strings as described with previous embodiments.

Shown in FIGS. 7 and 7A is a pumping system 270 which is similar to pumping system 200 of FIG. 6 except that pumping system 270 includes a tubing pump 272. Pumping system 270 comprises a casing 274 having vents 276 and 278. A plurality of perforations 280 are provided in casing 274 to allow production fluids to pass into casing 274. A casing flange 282 is attached to a dual well head flange 284 to hold the two tubing strings 286, 288 in place.

Disposed within casing 274 is a power tubing string 286 and a production tubing string 288. A crossover flow head 290 connects production tubing string 288 to power tubing string 286. Conveniently, a tubing release 292 is provided to allow production tubing string 288 to be attached to crossover flow head 290. Crossover flow head 290 includes a power tubing string portion 294 and a production tubing string portion 296 which allow production fluids passing upwardly through power tubing section 286 to be diverted into production tubing string 288 in a manner similar to that previously described with other embodiments.

Passing through power tubing section 286 is a solid rod 298 which is moved up and down to operate tubing pump 272 as described in greater detail hereinafter. Conveniently, an on/off tool 300 is provided to allow convenient removal of solid rod 298. A tubing drain 302 is provided to allow fluids to be drained from the system during disassembly as is known in the art.

A hollow rod 304 is attached to solid rod 298 via a check valve 306. Further down power tubing string 286, hollow rod 304 is connected to a plunger 308 which is part of tubing pump 272. Tubing pump 272 further comprises a tubing pump barrel 310, a traveling valve 312 and a standing valve 314. Further, a sealing unit 316 is provided to prevent the flow of production fluids upwardly through power tubing string 286 so that the flow may be diverted into production tubing string 288. During operation, hollow rod 304 is lifted to lift plunger 308. This action causes a vacuum within tubing pump barrel 310, causing standing valve 314 to lift and production fluids to enter into tubing pump barrel 310 as indicated by arrows 318. Upon downstroke of rod 304, standing valve 314 is seated while traveling valve 312 is lifted to allow the production fluids within tubing pump barrel 310 to pass through plunger 308 and into crossover flow head 290. As illustrated by arrows 320, the production fluids are then diverted into production tubing string 288 where they will exit above the earth's surface. Free gases may travel around production tubing string 286 as indicated by arrow 322.

A port 324 is provided to allow a lubricant or diluent to be introduced into power tubing string 286 as indicated by arrows 326. The introduced lubricant passes through a hole 328 in check valve 306. When the introduced lubricant is at a sufficient pressure, spring valve 330 will release to allow the lubricant to pass through hollow rod 304 as shown. The lubricant will then exit hollow rod 304 in the middle of plunger 308 as shown by the arrows. Additional lubricant may pass through the entire length of hollow rod 304 where it will exit through apertures 332 as shown. In this way, the lubricant or diluent may be supplied to the production fluids to assist in their removal from the well. Further, the lubricant introduced near plunger 308 will provide the necessary lubricant in order to lubricate tubing pump 272.

Figure 8A:
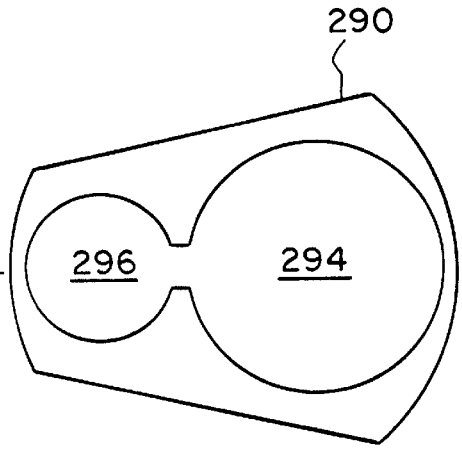
FIG. 8A is a cross-sectional view of a crossover flow head of the pumping system of FIG. 8.

Referring now to FIGS. 8 and 8A, another embodiment of a pumping system 340 will be described. Pumping system 340 is similar to pumping system 270 of FIG. 7 except that pumping system 340 employs a progressive cavity pump 342. For convenience of discussion, the elements of pumping system 340 which are similar to those in pumping system 270 will be referred to with identical reference numerals.

Progressive cavity pump 342 comprises a hollow rotor 344 which is connected to hollow rod 304. Hollow rotor 344 in turn is attached to a stator 346. In this way, when rotor 344 is rotated by rod 304, stator 346 will draw production fluids from the well, into power tubing string 286 and into crossover flow head 290. In crossover flow head 290, the production fluid is diverted from portion 294 to portion 296 to allow production fluids to be passed through production tubing string 288 as previously described. Hollow rotor 344 is connected to a passthrough stinger rod 348 having orifices 332. In this way, a lubricant or diluent may be introduced into port 324 where it will pass through check valve 306 in a manner similar to that previously described with system 270. The lubricant or diluent will then pass through orifices 332 and will be drawn into the suction of the pump 342 in power tubing string 286. The diluent will serve to dilute the production fluids to assist in their removal from the well, while the lubricant will lubricate the rotor and stator to enhance operation of progressive cavity pump 342.

Figures 9, 9A, 9B, 9C:
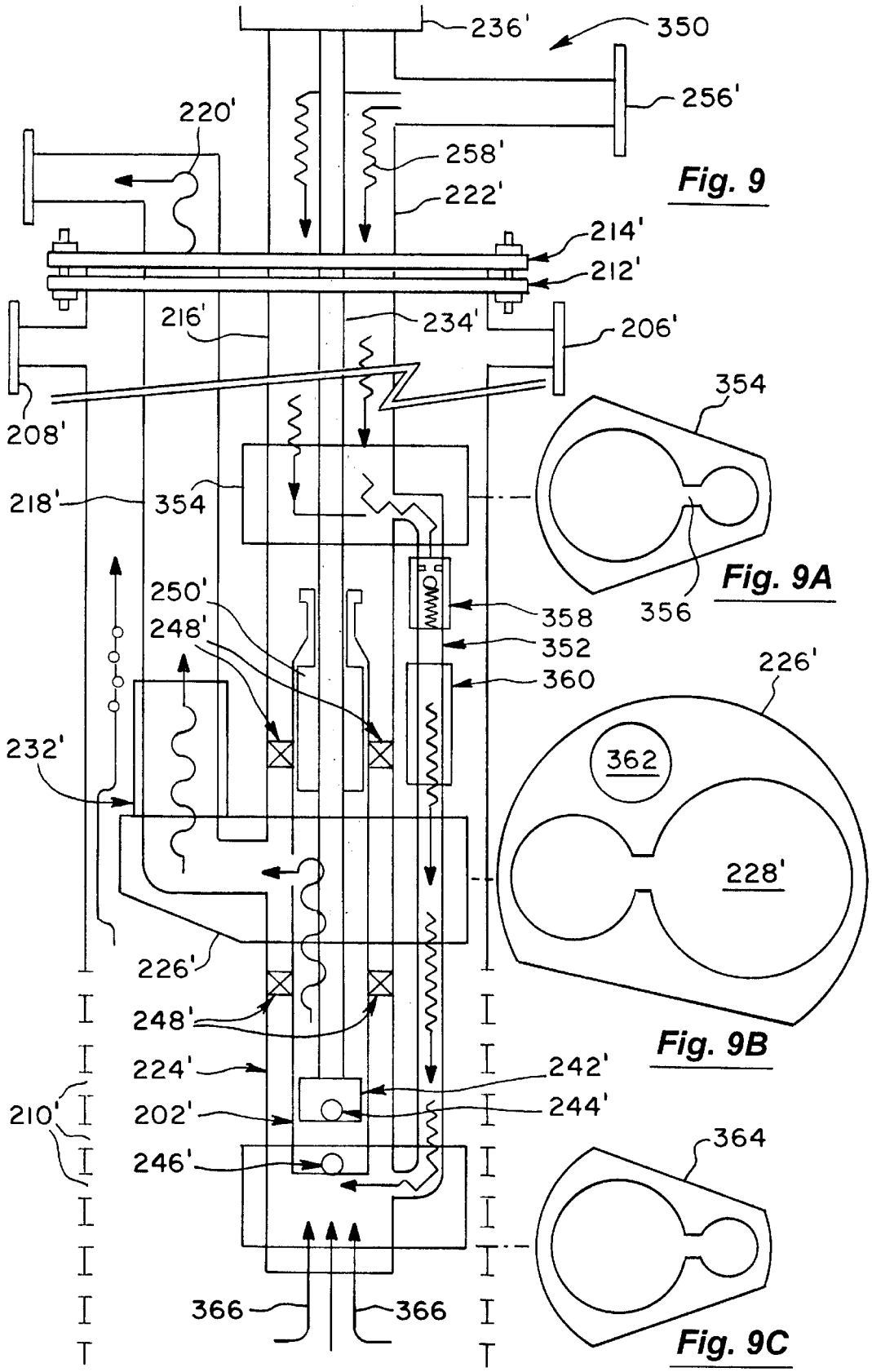
FIG. 9 is a diagrammatic vertical sectional view of a pumping system having an insert pump and a lubricant flow path which bypasses a crossover flow mechanism to supply a lubricant to a pump according to the invention.
FIG. 9A is a cross-sectional view of a stinger head of the pumping system of FIG. 9.
FIG. 9B is a cross-sectional view of a crossover flow head of the pumping system of FIG. 9.
FIG. 9C is a cross-sectional view of a fluid mixing head of the pumping system of FIG. 9.
Figures 10, 10A, 10B, 10C:
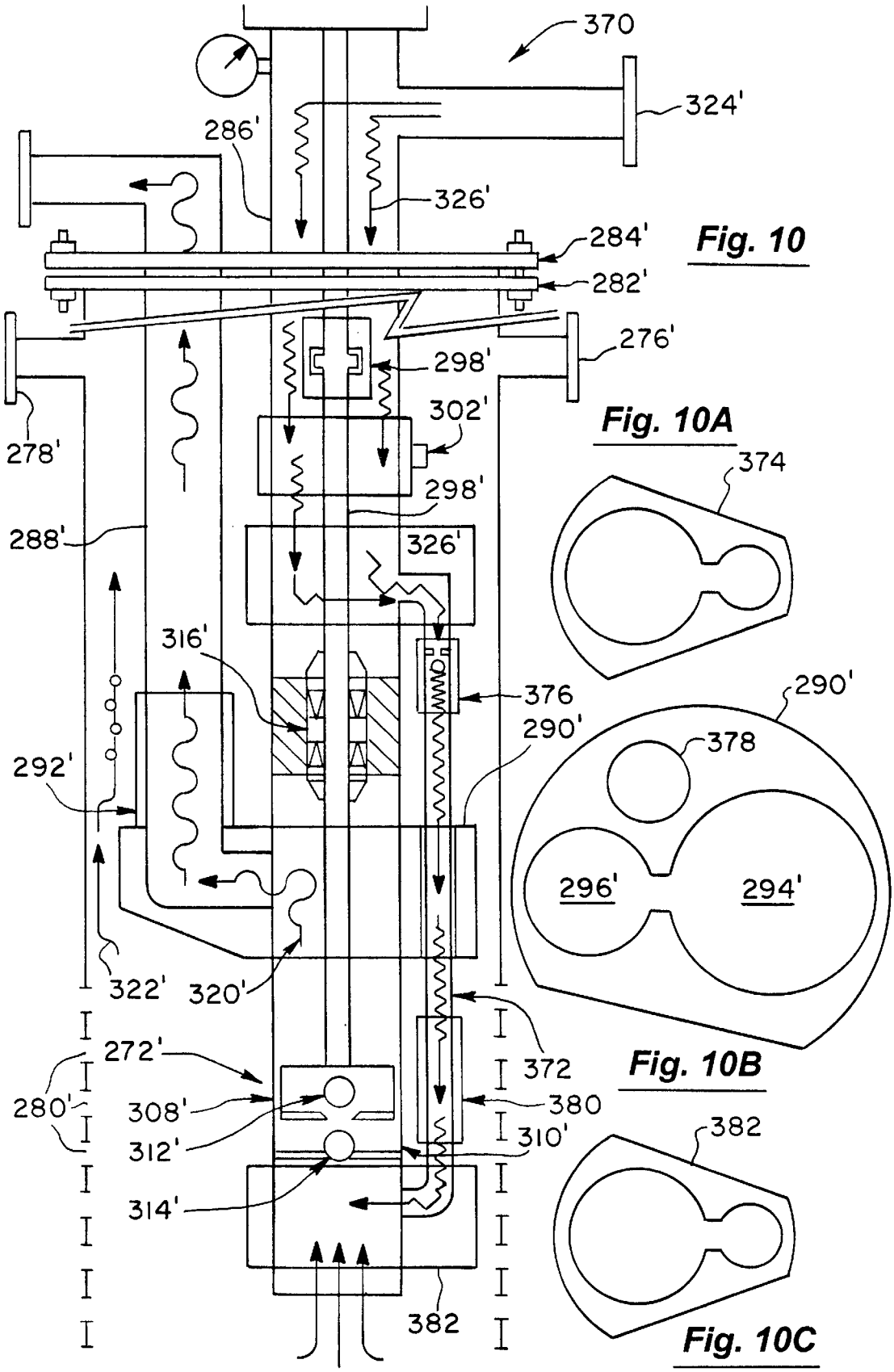
FIG. 10 is diagrammatic vertical sectional view of a pumping system having a tubing pump and a lubricant flow path which bypasses a crossover flow mechanism according to the invention.
FIG. 10A is a cross-sectional view of a stinger head of the pumping system of FIG. 10.
FIG. 10B is a cross-sectional view of a crossover flow head of the pumping system of FIG. 10.
FIG. 10C is a cross-sectional view of a fluid mixing head of the pumping system of FIG. 10.
Figures 11, 11A, 11B, 11C:
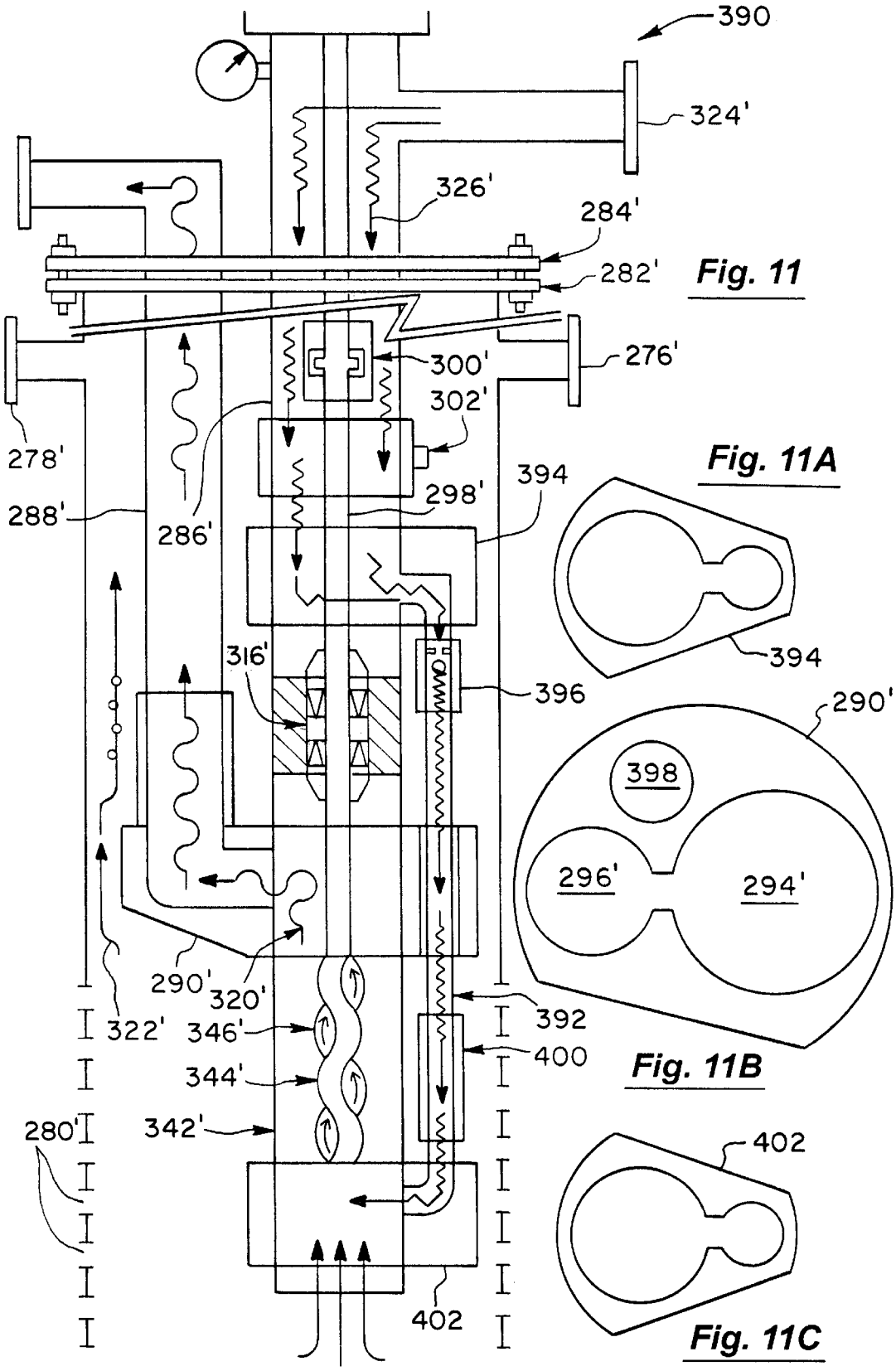
FIG. 11 is a diagrammatic vertical sectional view of a pumping system having a progressive cavity pump and a lubricant flow path which bypasses a crossover flow mechanism according to the invention.
FIG. 11A is a cross-sectional view of a stinger head of the pumping system of FIG. 11.
FIG. 11B is a cross-sectional view of a crossover flow head of the pumping system of FIG. 11.
FIG. 11C is a cross-sectional view of a fluid mixing head of the pumping system of FIG. 11.

FIGS. 9, 10 and 11 show respective alternative embodiments of the pumping systems of FIGS. 6, 7 and 8. The embodiments in FIGS. 9–11 differ in that the lubricant or diluent passes from the power tubing string through a stinger head, around the crossover flow head, and down to a fluid mixing head at the suction of the pump. In this way, the need for hollow rods is eliminated since the lubricant is passed around the cross over flow head.

Referring now to FIGS. 9–9C, another embodiment of a pumping system 350 will be described. For convenience of discussion, pumping system 350 will be described using similar reference numerals to describe pumping system 200 of FIG. 6 with the addition of a "'". Pumping system 350 differs from pumping system 200 in that pumping system 350 includes a side tubing string 352 which allows a lubricant 258' to bypass portion 228' of crossover head 226'. A stinger head 354 (see FIG. 9A) allows for the diversion of the lubricant from power tubing string 216' and into side tubing string 352 as shown. Sealing unit 250' prevents the flow of lubricant further down power tubing string 216'.

As best illustrated in FIG. 9A, a crossover fluid path 356 is provided to allow the lubricant to pass from power tubing string 216' and into side tubing string 352. A check valve 358 is provided in side tubing string 352 to regulate the flow of lubricant through side tubing string 352. In particular, check valve 358 includes a spring which allows the valve to open when a sufficient pressure is applied by the lubricant. After passing through check valve 358, the lubricant passes through an adjustable union 360 and through a lumen 362 in crossover flow head 226' (see FIG. 9B). The lubricant continues through side tubing string 352 and into a fluid mixing head 364 (see FIG. 9C). In fluid mixing head 364, the lubricant is channeled into power tubing string 216' in the vicinity of insert pump 202' suction. In this way, when insert pump 202' is operated, sufficient lubricant will be provided. In operation, plunger 242', traveling valve 244' and standing valve 246' operate similar to related elements in insert pump 202 of FIG. 6 to pump production fluids from the well as indicated by arrows 366.

Referring now to FIGS. 10–10C, a further embodiment of a pumping system 370 will be described. For convenience of discussion, pumping system 370 will be described using similar reference numerals to those used previously in describing pumping system 270 of FIG. 7 followed by a "'". Pumping system 370 differs from pumping system 270 of FIG. 7 in that pumping system 370 includes a side tubing string 372 to bypass a lubricant around cross over flow head 290'. A stinger head 374 (see FIG. 10A) is provided to divert the flow of the lubricant as indicated by arrows 326' into side tubing string 372. A check valve 376 is provided within side tubing string 372 to regulate the flow of lubricant through side tubing string 372 similar to valve 358 of FIG. 9. As best shown in FIG. 10B, crossover flow head 290' includes a lumen 378 through which side tubing string 372 passes. An adjustable union 380 is also provided in side tubing string 372. A fluid mixing head 382 is provided to divert the flow of lubricant from side tubing string 372 and back into power tubing string 286' as shown. In this way, a lubricant will be provided to lubricate tubing pump 270'. Tubing pump 270' includes a plunger 308', a traveling valve 312' and a standing valve 314' which operate to pump production fluids from the well and up through power tubing string 286' similar to the embodiment in FIG. 7. Further, crossover flow head 290' diverts the flow of the production fluid from portion 294' to portion 296' where it will pass through production tubing string 288' similar to the embodiment of FIG. 7.

Referring now to FIGS. 11–11C, still yet another embodiment of a pumping system 390 will be described. Pumping system 390 is similar to pumping system 340 of FIG. 8 except that the lubricant is bypassed around a portion of the power tubing string. For convenience of discussion, similar elements will employ the use of similar reference numerals followed by a "'".

Pumping system 390 differs from pumping system 340 in that the lubricant bypasses a portion of power tubing string 286' through a side tubing string 392. In particular, a stinger head 394 (see FIG. 11A) in combination with sealing unit 316' diverts the flow of lubricant from power tubing string 286' and into side tubing string 392 as illustrated by arrows 326'. A lubricant then passes through a check valve 396 similar to check valve 376 of FIG. 10 which regulates the flow of lubricant through side tubing string 392. A lumen 398 is provided within crossover flow head 290' to allow side tubing string 392 to pass through crossover flow head 290'. An adjustable union 400 is also provided in side tubing string 392. Finally, a fluid mixing head 402 (see FIG. 11C) is provided to divert the flow of lubricant from side tubing string 392 back into power tubing string 286' in the vicinity of progressive cavity pump 342' suction. In this way, progressive cavity pump 342' will receive sufficient lubrication for operation.

Upon rotation of rod 298', rotor 344' is rotated inside stator 346'. In turn, this causes production fluids within the well to be drawn up into the lower portion of power tubing string 286'. The production fluids will then be diverted into production tubing string 288' in a manner similar to that previously described.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. Variations and changes may be made by others without departing from the spirit of the present invention. Accordingly, all such variations and changes which fall within the spirit and scope of the present invention is defined in the following claims are expressly intended to be embraced thereby.

What is claimed is:

1. Apparatus for producing well fluids from an oil bearing formation penetrated by a well, the apparatus comprising:

a production tubing string forming a production flow path for production fluids, the production tubing string being adapted to be positioned between the earth's surface and a location in the well suitable for receiving well production fluids;

a power tubing string having a lower portion and an upper portion, the power tubing string being adapted to extend down the well in a generally parallel relationship with the production tubing string to a location in the well suitable for receiving production fluids into the lower portion of the power tubing string from the well;

a pumping apparatus disposed in the power tubing string which is adapted to pump well fluids from the well into the lower portion of the power tubing string; and a cross-over flow mechanism between the lower portion of the power tubing string and the flow path of the production tubing string to divert the flow of production fluids out of the power tubing string and into the flow path of the production tubing string for transfer to the earth's surface.

2. An apparatus as in claim 1, wherein the production flow path has a smaller cross sectional area than the lower portion of the power tubing string to increase the velocity of the production fluids when diverted into the production flow path.

3. An apparatus as in claim 1, further comprising a lubricant flow path which is adapted to extend from the earth's surface to a location near the pumping apparatus to allow a lubricant to be introduced to the pumping apparatus.

4. An apparatus as in claim 3, wherein the lubricant flow path passes through the power tubing string.

5. An apparatus as in claim 4, wherein the lubricant flow path passes through the cross-over flow mechanism.

6. An apparatus as in claim 5, further comprising at least one rod extending through the power tubing string to operate the pumping mechanism.

7. An apparatus as in claim 6, wherein the lubricant flow path passes at least partially through the rod.

8. An apparatus as in claim 5, wherein the pumping mechanism is selected from the group of pumping mechanisms consisting of insert pumps, progressive cavity pumps and tubing pumps.

9. An apparatus as in claim 3, wherein the lubricant flow path by-passes the cross-over flow mechanism.

10. An apparatus as in claim 9, further comprising a side tubing string having a bottom end which is connected to the lower portion of the power tubing string, and wherein the lubricant flow path extends through the side tubing string.

11. An apparatus as in claim 10, wherein the pumping mechanism is selected from the group of pumping mechanisms consisting of insert pumps, progressive cavity pumps and tubing pumps.

12. Apparatus for producing well fluids from an oil bearing formation penetrated by a well, the apparatus comprising:

a production tubing string forming a production flow path for production fluids, the production tubing string being adapted to be positioned between the earth's surface and a location in the well suitable for receiving well production fluids;

a power tubing string having a lower portion and an upper portion, the power tubing string being adapted to extend down the well in a generally parallel relationship with the production tubing string to a location in the well suitable for receiving production fluids into the lower portion of the power tubing string from the well;

a pumping apparatus disposed in the power tubing string which is adapted to pump well fluids from the well into the lower portion of the power tubing string;

a cross-over flow mechanism between the lower portion of the power tubing string and the flow path of the production tubing string to divert the flow of production fluids out of the power tubing string and into the flow path of the production tubing string for transfer to the earth's surface; and a lubricant flow path which is adapted to extend from the earth's surface to a location near the pumping apparatus to allow a lubricant to be introduced to the pumping apparatus.

13. An apparatus as in claim 12, wherein the lubricant flow path passes through the power tubing string.

14. An apparatus as in claim 13, wherein the lubricant flow path passes through the cross-over flow mechanism.

15. An apparatus as in claim 14, further comprising at least one rod extending through the power tubing string to operate the pumping mechanism.

16. An apparatus as in claim 15, wherein the lubricant flow path passes at least partially through the rod.

17. An apparatus as in claim 14, wherein the pumping mechanism is selected from the group of pumping mechanisms consisting of insert pumps, progressive cavity pumps and tubing pumps.

18. An apparatus as in claim 12, wherein the lubricant flow path by-passes the cross-over flow mechanism.

19. An apparatus as in claim 18, further comprising a side tubing string having a bottom end which is connected to the lower portion of the power tubing string, and wherein the lubricant flow path extends through the side tubing string.

20. An apparatus as in claim 19, wherein the pumping mechanism is selected from the group of pumping mechanisms consisting of insert pumps, progressive cavity pumps and tubing pumps.

21. Apparatus for producing well fluids from an oil bearing formation penetrated by a well, the apparatus comprising:

a production tubing string forming a production flow path for production fluids, the production tubing string being adapted to be positioned between the earth's surface and a location in the well suitable for receiving well production fluids;

a power tubing string having a lower portion and an upper portion, the power tubing string being adapted to extend down the well in a generally parallel relationship with the production tubing string to a location in the well suitable for receiving production fluids into the lower portion of the power tubing string from the well;

a pumping apparatus disposed in the power tubing string which is adapted to pump well fluids from the well into the lower portion of the power tubing string;

a cross-over flow mechanism between the lower portion of the power tubing string and the flow path of the production tubing string to divert the flow of production fluids out of the power tubing string and into the flow path of the production tubing string for transfer to the earth's surface; and a lubricant flow path which is adapted to extend from the earth's surface to a location near the pumping apparatus to allow a lubricant to be introduced to the pumping apparatus, wherein the lubricant flow path passes through the cross-over flow mechanism.

22. An apparatus as in claim 21, further comprising at least one rod extending through the power tubing string to operate the pumping mechanism.

23. An apparatus as in claim 22, wherein the lubricant flow path passes at least partially through the rod.

24. An apparatus as in claim 23, wherein the pumping mechanism is selected from the group of pumping mechanisms consisting of insert pumps, progressive cavity pumps and tubing pumps.

* * * * *